US011438695B1

(12) United States Patent
Schreibman et al.

(10) Patent No.: US 11,438,695 B1
(45) Date of Patent: Sep. 6, 2022

(54) BEAMFORMING TECHNIQUES FOR ACOUSTIC INTERFERENCE CANCELLATION

(71) Applicant: GM GLOBAL TECHNOLOGY OPERATIONS LLC, Detroit, MI (US)

(72) Inventors: Amos Schreibman, Hod Hasharon (IL); Anna Barnov, Tel Mond (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/203,905

(22) Filed: Mar. 17, 2021

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01); *H04R 2201/401* (2013.01)

(58) Field of Classification Search
CPC ... H04R 3/005; H04R 1/326; H04R 2201/401
USPC ..... 381/92, 313
See application file for complete search history.

(56) References Cited

U.S. PATENT DOCUMENTS

2007/0093714 A1* 4/2007 Beaucoup ..... H04M 9/085 600/437
2007/0165871 A1* 7/2007 Roovers ..... H04R 3/02 381/66
2008/0298602 A1* 12/2008 Wolff ..... H04M 9/082 704/E21.007
2009/0055170 A1* 2/2009 Nagahama ..... G10L 21/0272 704/226

* cited by examiner

*Primary Examiner* — Paul Kim
*Assistant Examiner* — Douglas J Suthers
(74) *Attorney, Agent, or Firm* — Lorenz & Kopf LLP

(57) ABSTRACT

The present application relates to a system and method for receiving, via a microphone array, an incoming acoustic signal including a desired signal and an undesired signal, performing a first minimum variance distortionless response beamforming operation on the incoming acoustic signal to isolate the desired signal, performing a second minimum variance distortionless response beamforming operation, by the signal processor, on the incoming acoust signal to isolate the undesired signal, filtering the desired signal to generate a filtered desired signal, combining an inverse of the filtered desired signal with the undesired signal to generate a combined undesired signal, filtering the combined undesired signal to generate a filtered combined undesired signal, combining an inverse of the combined undesired signal and the desired signal to generate an output signal, and generating a data signal in response to the output signal for transmission via a wireless network.

19 Claims, 5 Drawing Sheets

BEAMFORMING TECHNIQUES FOR ACOUSTIC INTERFERENCE CANCELLATION

BACKGROUND

The present disclosure relates generally to programming motor vehicle audio and sound suppression systems. More specifically, aspects of this disclosure relate to systems, methods and devices for robust interference tracking and cancellation to maintain desired source undistorted response for a multi microphone processing by utilizing an alternative scheme to the optimally tuned linearly constrained minimum variance (LCMV) beamformer for tracking and cancelling undesired noise sources.

Driver attentiveness is a primary factor in safe vehicle operation. With the increased use of mobile devices and vehicle automation, the opportunities for driver distraction continue to increase. Hands free calling has been widely implemented in modern vehicle so that the driver may conduct a two way voice conversation via a mobile phone, while not distracting the driver's hands and focus of attention. Hands free calling uses a wireless connection to transfer audio data between the mobile phone and the vehicle infotainment system. The driver's voice is captured by a microphone within the vehicle cabin and the remote party's voice is played via speakers within the vehicle cabin. A problem arises in that sound from the speakers as well as the voices of other vehicle occupants and other ambient noises may be picked up by the microphone causing feedback and/or making the driver's voice unintelligible. To address this problem, beamforming has been employed using multiple microphones to increase the sensitivity of the system towards the driver and attenuating sounds not originating from the driver position.

Linear constrained minimum variance (LCMV) beamforming is a multichannel signal processing technique used to enhance acoustic signals coming from a known direction and attenuating unwanted acoustic signals coming from other directions. Beamforming techniques are widely used to enhance desired speech signals. They utilize spatial diversity of multiple microphones to enhance the desired speaker voice. For example, hands free calling systems in a vehicle cabin employs multiple microphones to enhance the driver voice under cabin noise and competing speakers within the environment. For that, the LCMV beamforming technique is commonly used. The LCMV spatial notch pointing at the interference is usually very sharp, resulting in poor interference cancellation even for small movements of the interfering source. This fact calls for rapid tracking of the interfering source and frequent updates of the LCMV solution. High cadence updates of the LCMV beamformer are computationally expensive and can lead to poor noise cancellation especially for GSC based LCMV implementation. It is desirable to address these problems to provide improved beamforming techniques for acoustic interference cancellation. The above information disclosed in this background section is only for enhancement of understanding of the background of the invention and therefore it may contain information that does not form the prior art that is already known in this country to a person of ordinary skill in the art.

SUMMARY

Disclosed herein are vehicle communications systems, vehicle user interface systems and related control logic for provisioning vehicle user interface systems, methods for making and methods for operating such systems, and motor vehicles equipped with user interface systems. By way of example, and not limitation, there is presented a user interface system for isolating a desired acoustic signal received by the vehicle microphones, performing a beamformer operation to isolate the desired acoustic signal, cancelling the desired signal from the undesired acoustic signal path, filtering the undesired acoustic signal path and cancelling an undesired signal within the desired signal path with the filtered undesired acoustic signal.

In accordance with an aspect of the present disclosure, an apparatus including 2 or more microphones to receive an incoming acoustic signal including a desired acoustic signal and an undesired acoustic signal, a signal processor configured to perform a first beamforming operation on the incoming acoustic signal to isolate the desired signal from the incoming acoustic signal, to perform a second beamforming operation to isolate the undesired signal from the incoming acoustic signal, filtering the desired signal to generate a filtered desired signal, combining an inverse of the filtered desired signal with the undesired signal to generate a combined undesired signal, filtering the combined undesired signal to generate a filtered combined undesired signal and combining an inverse of the filtered combined undesired signal and the desired signal to generate an output signal, and a communications processor to generate a data signal in response to the output signal for transmission via a wireless network.

In accordance with another aspect of the present disclosure, wherein the microphone array includes a plurality of microphones within a vehicle passenger cabin.

In accordance with another aspect of the present disclosure, wherein the first beamforming operation on the incoming acoustic signal is further configured to apply a linear weight to a phase angle of the undesired signal.

In accordance with another aspect of the present disclosure, wherein the filtering of the desired signal is an adaptive filtering with a frequency centered on the frequency of the desired signal.

In accordance with another aspect of the present disclosure, wherein the second beamforming operation on the incoming acoustic signal is further configured to apply a linear weight to a phase angle of the desired signal.

In accordance with another aspect of the present disclosure, wherein the desired signal includes an outgoing portion of a bidirectional voice communications and wherein the wireless network includes a cellular network.

In accordance with another aspect of the present disclosure, wherein the filtering of the desired signal attenuates the undesired signal with the desired signal.

In accordance with another aspect of the present disclosure, wherein the filtering of the combined undesired signal attenuates the desired signal with the combined undesired signal.

In accordance with another aspect of the present disclosure, wherein the undesired signal originates from a first source at a first location within a vehicle cabin and the desired signal originates from a second source at a second location within the vehicle cabin.

In accordance with another aspect of the present disclosure, a method including receiving, via a plurality of microphones, an incoming acoustic signal including a desired signal and an undesired signal, perform a first beamforming operation, by a signal processor, on the incoming to isolate the desired signal from the incoming acoustic signal, performing a second beamforming operation, by the signal processor, to isolate the undesired signal from the incoming acoustic signal, filtering, by the signal processor, the desired signal to generate a filtered desired signal, combining an inverse of the filtered desired signal with the undesired signal to generate a combined undesired signal, filtering, by the signal processor, the combined undesired signal to generate a filtered combined undesired signal, combining, by the signal processor, an inverse of the filtered combined undesired signal and the desired signal to generate an output signal, and generating, by a communications processor, a data signal in response to the output signal for transmission via a wireless network.

In accordance with another aspect of the present disclosure, wherein microphone array includes a plurality of microphones within a vehicle passenger cabin.

In accordance with another aspect of the present disclosure, wherein the second beamforming operation on the incoming acoustic signal is further configured to apply a linear weight to a phase angle of the desired signal.

In accordance with another aspect of the present disclosure, wherein the filtering of the desired signal is an adaptive filtering with a frequency centered on the frequency of the desired signal.

In accordance with another aspect of the present disclosure, wherein the first beamforming operation on the incoming acoustic signal is further configured to apply a linear weight to a phase angle of the undesired signal.

In accordance with another aspect of the present disclosure, wherein the filtering of the desired signal attenuates the undesired signal with the desired signal.

In accordance with another aspect of the present disclosure, wherein the filtering of the combined undesired signal attenuates the desired signal with the combined undesired signal.

In accordance with another aspect of the present disclosure, wherein the undesired signal originates from a first source at a first location within a vehicle cabin and the desired signal originates from a second source at a second location within the vehicle cabin.

In accordance with another aspect of the present disclosure, wherein the desired signal an outgoing portion of a bidirectional voice communications and wherein the wireless network is a cellular network.

In accordance with another aspect of the present disclosure, a hands-free telecommunications system within a vehicle cabin including a plurality of microphones to receive an incoming acoustic signal including a desired signal and an undesired signal, an analog to digital converter to convert the incoming acoustic signal to a digital signal including the desired voice signal and the undesired voice signal, a digital signal processor to perform a first beamforming operation on the digital signal to isolate the desired signal from the digital signal, to perform a second beamforming operation to isolate the undesired signal from the digital signal, filtering the desired signal to generate a filtered desired signal, combining an inverse of the filtered desired signal with the undesired signal to generate a combined undesired signal, filtering the combined undesired signal to generate a filtered combined undesired signal and combining an inverse of the filtered combined undesired signal and the desired signal to generate an output signal, and a communications processor to generate a data signal in response to the output signal for transmission via a wireless network.

In accordance with another aspect of the present disclosure, wherein the first beamforming operation on the incoming acoustic signal is further configured to apply a linear weight to a phase angle of the undesired signal.

The above advantage and other advantages and features of the present disclosure will be apparent from the following detailed description of the preferred embodiments when taken in connection with the accompanying drawings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

The exemplifications set out herein illustrate preferred embodiments of the invention, and such exemplifications are not to be construed as limiting the scope of the invention in any manner.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting but are merely representative. The various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
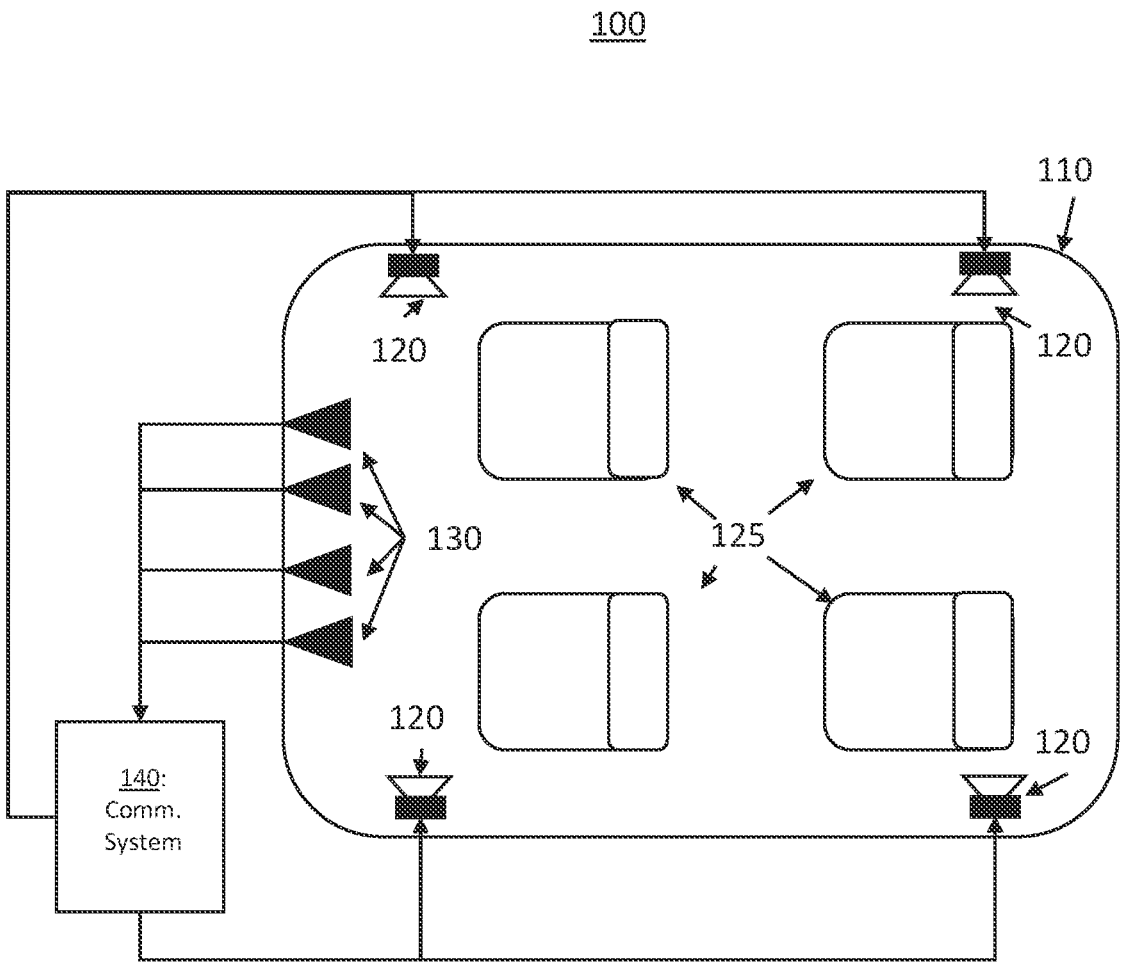
FIG. 1 shows an operating environment for providing beamforming techniques for acoustic interference cancellation in a bidirectional vehicle communications system according to an exemplary embodiment.

FIG. 1 shows an operating environment for providing beamforming techniques for acoustic interference cancellation in a bidirectional vehicle communications system according to an exemplary embodiment. The exemplary environment 100 shows a vehicle cabin 110 with a plurality of speakers 120 and a microphone array 130 coupled to a communications system 140. Within the vehicle cabin 110 there are also a plurality of vehicle occupant seating positions 125. Each of the plurality of speakers 120 may be configured to receive an incoming portion of an audio conversation from a communications system 140 and to broadcast the incoming portion within the vehicle cabin 110. Each of the plurality of microphones within the microphone array 130 is operative to receive an outgoing portion of an audio conversation and to transmit this outgoing portion to the communications system 140 for transmission via a wireless network, such as a cellular telephone network or the like.

An array of microphones 130 are employed to allow for beamforming the directivity of the array in order to enhance the sound detection sensitivity in some directions while reducing the sensitivity in other directions. For example, in an automotive application it is desirable to have greater sensitivity in direction of the driver's head while reducing sensitivity in the direction of the speakers. The communications system 140 may include a signal processor for performing a beamforming operation, such as a minimum variance distortionless response (MVDR) beamforming operation. An MVDR beamformer produces a distortionless response in the direction of the signal of interest due to a linear weight at the phase angle of the signal of interest while attenuating other signals from different directions. The exemplary system may track and cancel undesired signals from other sources, while keeping the desired source intact. The exemplary system may achieve the optimal performance that can be achieved by a perfectly tuned LCMV beamformer while introducing high robustness and low complexity implementation, which will ensure superior performance in the end product.

It should be appreciated that the illustrated embodiment has been simplified for ease of understanding, and that the bidirectional communications system 100 may include additional devices, processing modules, and elements that support additional features and functions that need not be described in detail here. Likewise, those skilled in the art will recognize that an embodiment of the vehicle cabin 110 will include many conventional features, subsystems, and components that are commonly found in modern vehicles. Such conventional aspects of the vehicle cabin 110 will not be described here.

Figure 2:
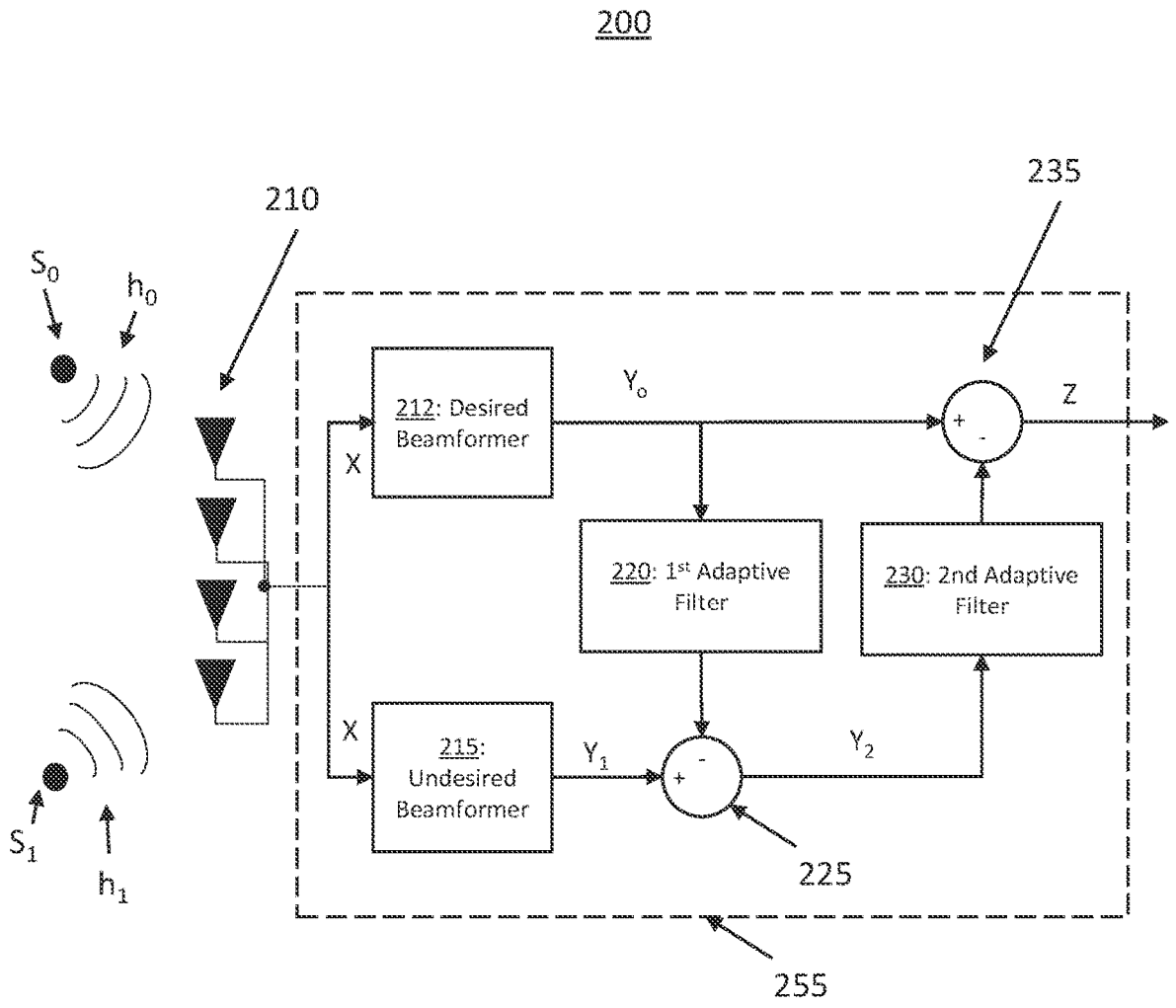
FIG. 2 shows a block diagram illustrating an exemplary system for providing beamforming techniques for acoustic interference cancellation in a bidirectional vehicle communications system according to an exemplary embodiment.

Turning now to FIG. 2, a block diagram illustrating an exemplary implementation of a system 200 for providing beamforming techniques for acoustic interference cancellation in a bidirectional vehicle communications system is shown. The system exemplary 200 may include a plurality of microphones 210 arranged into a microphone array, a desired source $S_0$, an undesired source $S_1$, a first acoustic transfer function $h_0$, a second acoustic transfer function $h_1$, a desired signal beamformer 212, an undesired signal beamformer 215, a first mixer 225 a second mixer 235 a first adaptive filter 220 and a second adaptive filter 230. In some embodiments, some of these components may be functions performed by a signal processor 255, such as a digital signal processor or the like. The plurality of microphones 210 may include two or more microphones located as an array at a location within a vehicle cabin, or may include a plurality of microphones positioned at different positions within a vehicle cabin.

Consider an enclosure with 2 sources, a desired source $S_0$ and an undesired source $S_1$. The sources are impinging on the plurality of microphones 210. There exists a first acoustic transfer function $h_0$, and a second acoustic transfer function $h_1$ between each source $S_0$, $S_1$ and the plurality of microphones 210. A noise signal (v) consisting of any combination of white, diffused and directional noises is picked up by the microphone array 210. The noise coherence matrix is denoted as ΦV and assumed to be Hermitian ΦV=ΦH V. The objective of the system 200 is threefold: 1) maintain a distortion less response toward the desired speaker, 2) cancel the undesired source, 3) minimize the noise power at the output signal. This is performed in two stages; the first stage will generate two distortion-less responses with respect to each of the sources in order to minimize the noise in the output signal. The second stage will employ Adaptive Filter (AF) techniques in order to cancel the undesired source from the desired signal.

The particular two stage approach is similar to a Linearly Constrained Minimum Variance (LCMV) beam-former performance with a distortion less constraint towards the desired source and complete cancellation constraint toward the un-desired source. The desired source $S_0$ emits a desired signal to be enhanced and transmitted by the system 200. For example, the desired source $S_0$ may be a vehicle occupant emitting a desired voice signal. The acoustic transfer function $h_0$ between the desired source $S_0$ and the plurality of microphones 210 is dependent on the source direction with respect to the microphone array, the transmission medium, reflective surfaces within the environment and defines the relationship between the sound level of the source and the sound level received at the plurality of microphones 210. The undesirable signal $S_1$ may be a voice of a second occupant, vehicle engine noise or other point source of undesirable noise or the like. The plurality of microphones 210 are configured to receive both the signal of interest from the desired source $S_0$ and the undesired signal from the undesirable source $S_1$ via the acoustic transfer function $h_1$ between the undesired source $S_1$ and the plurality of microphones 210. The plurality of microphones may also include an analog to digital converter for converting the received acoustic signals, such as the desired signal and the undesired signal, into digital acoustic signals.

After the desired signal and the undesired signal are received at the plurality of microphones, a combined signal X including both the desired signal and the undesired signal is coupled the first stages of the interference cancelling system, and is defined by:

$$x=h_0s_0+h_1s_1+v$$

In a first signal path, the signal X is coupled to a desired signal first stage beamformer 212 for application of a first beamformer weight $W_0$ of the interference canceller on a desired signal path and an undesired signal first stage beamformer 215 for application of a second beamformer weight $W_1$ of the interference canceller on the undesired signal path. The beamformer weights $W_0$, $W_1$ can be configured by applying an MVDR criterion resulting in two beamformer weights $W_0$, $W_1$ as defined by $$w_i = \frac{\Phi_V^{-1} h_i}{h_i^H \Phi_V^{-1} h_i},\ i = [0, 1]$$

The signals output from each of the first stage MVDRs are defined by:

$$y_0 = w_0^H x = s_0 + \frac{h_0^H \Phi_V^{-1} h_1}{h_0^H \Phi_V^{-1} h_0} s_1 + \frac{h_0^H \Phi_V^{-1}}{h_0^H \Phi_V^{-1} h_0} v$$

$$y_1 = w_1^H x = s_1 + \frac{h_1^H \Phi_V^{-1} h_0}{h_1^H \Phi_V^{-1} h_1} s_0 + \frac{h_1^H \Phi_V^{-1}}{h_1^H \Phi_V^{-1} h_1} v$$

where v is a variable noise component.

After the first stages of the MVDR, adaptive filters may be employed to further reduce the undesired signal components. Typically in an LCMV application, the undesired signal $S_1$ would be removed from X thereby leaving only the desired signal $S_0$. However, the LCMV directional notch filter pointing toward the undesired source is very sharp calling for the LCMV filter to be updated for every movement of $S_1$ which is a computational heavy process. Instead the use of adaptive filtering technique as portrayed by system 200 is suggested. An adaptive filter can track the changes in the location of $S_1$ therefore making the LCMV tracking problem irrelevant. A problem arises when using a simple adaptive filter between $Y_0$ and $Y_1$ in that the undesired signal $Y_1$ may still include attenuated components of $S_0$, so when $Y_1$ is removed from $Y_0$ some of the desired signal $S_0$ may be removed from $Y_0$ resulting in some self cancellation. The current proposed system employs a first adaptive filter 220 to first remove components of $S_0$ from $Y_1$. The desired signal canceller weight $a_0$ of the first adaptive filter 220 may be defined by:

$$a_0 = \frac{h_0^H \Phi_V^{-1} h_1}{h_1^H \Phi_V^{-1} h_1}$$

After the desired signal is filtered using weight $a_0$ and is deducted from the signal $Y_1$, using the first mixer 225 to generate the clean reference channel $Y_2$ defined by:

$$y_2 = \sin^2(\theta) s_1 + \frac{h_1^H \Phi_V^{-1} T_0^H}{h_1^H \Phi_V^{-1} h_1} v$$

where $$\sin^2(\theta) = \left(1 - \frac{|h_0^H \Phi_V^{-1} h_1|^2}{h_0^H \Phi_V^{-1} h_0 h_1^H \Phi_V^{-1} h_1}\right)$$

The clean reference signal $Y_2$ may then be applied to the second adaptive filter 230 defined by:

$$a_1 = \frac{h_1^H \Phi_V^{-1} h_0}{h_0^H \Phi_V^{-1} h_0 \sin^2(\theta)}$$

and then deducted from the signal $Y_0$ using the second mixer 235 to generate the clean output signal Z wherein:

$$z_{s_0} = s_0$$

-continued $$z_{s_1} = \left(\frac{h_0^H \Phi_V^{-1} h_1}{h_0^H \Phi_V^{-1} h_0} - \frac{h_0^H \Phi_V^{-1} h_1 \sin^2(\theta)}{h_0^H \Phi_V^{-1} h_0 \sin^2(\theta)}\right) s_1 = 0$$

$$E\{|z_0|^2\} = \frac{1}{h_0^H \Phi_V^{-1} h_0 \sin^2(\theta)}$$

with $Z_{So}$ being the desired signal component, $Z_{S1}$ being the undesired signal component, and $Z_v$ being the noise component. As the above formulae describe, the embodiment 200 produces a distortion less response toward $S_0$, and achieves complete cancellation toward the undesired signal $S_1$. the noise output energy is identical to the performance of an LCMV beamformer under the same constraints, thereby making the performance of the suggested embodiment identical to that of an LCMV beamformer.

Figure 3:
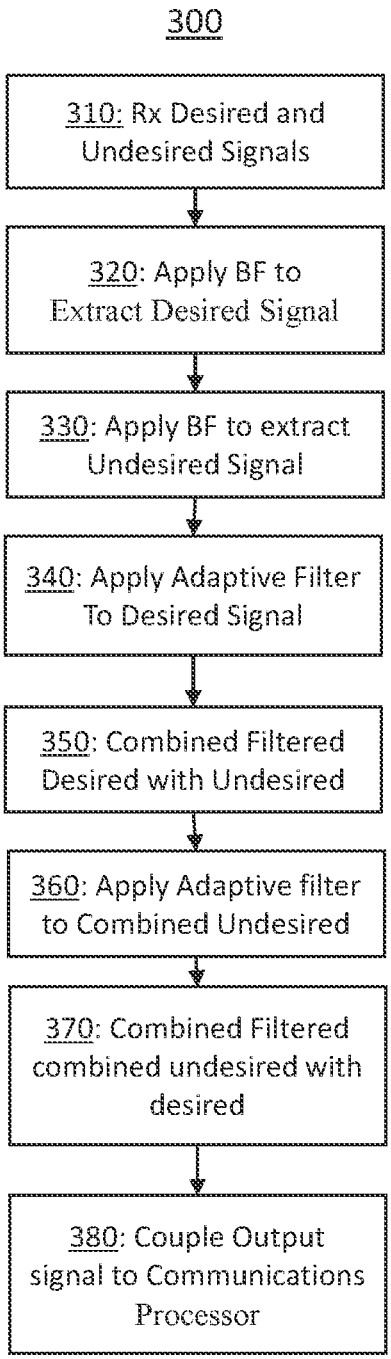
FIG. 3 shows a flow chart illustrating an exemplary method for providing beamforming techniques for acoustic interference cancellation in a bidirectional vehicle communications system according to another exemplary embodiment.

Turning now to FIG. 3, a flow chart illustrating an exemplary implementation of a method 300 for providing beamforming techniques for acoustic interference cancellation in a bidirectional vehicle communications system is shown. Initially, the method is operative for receiving 310 an acoustic signal at a microphone array where the acoustic signal includes a desired audio signal and an undesired audio signal. For example, the desired audio signal may include a voice of a driver and the undesired signal may include a backseat conversation or a mechanical noise. The microphone array may be comprised of a plurality of microphones arranged at various positions around a vehicle cabin.

A first beamforming weight is next applied 320 to the acoustic signal to isolate the desired signal and to attenuate the undesired signal. The results of the beamformer is a preserved desired signal with a filtered undesired signal. The method further applies 330 an acoustic signal to a second beamforming weight to generate a reference signal. The reference signal may isolate the undesired signal and filter the desired signal.

The method next applies 340 a first adaptive filter to the preserved desired signal to further isolate the desired signal and suppress the undesired signal. The filtered desired signal is then inverted and combined 350 with the reference signal to suppress the desired signal within the reference signal and to further isolate the undesired signal.

A second adaptive filter is then applied 360 to the reference signal to approximate the undesired signal. The filtered reference signal is then inverted and combined 370 with the desired signal to generate an output signal. The output signal is then coupled 380 to a communications processor or the like for further processing.

Figure 4:
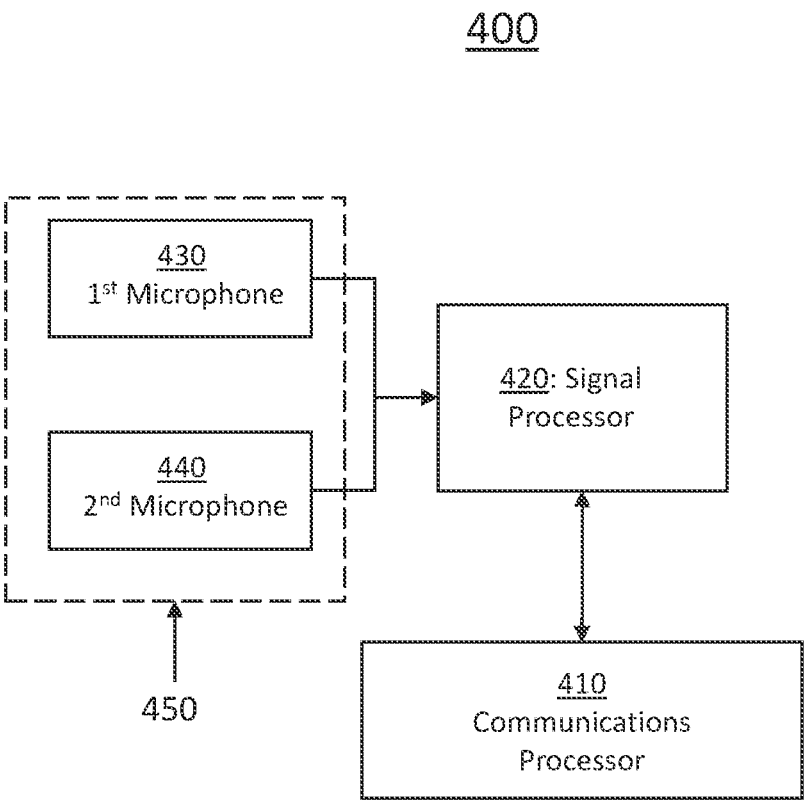
FIG. 4 shows a block diagram illustrating another exemplary system for providing beamforming techniques for acoustic interference cancellation in a bidirectional vehicle communications system according to another exemplary embodiment.

Turning now to FIG. 4, a block diagram illustrating another exemplary implementation of a system 400 for providing beamforming techniques for acoustic interference cancellation in a bidirectional vehicle communications system is shown. The exemplary system 400 may form a portion of a vehicle cabin hands free telecommunications system including a communications processor 410, a signal processor 420, a first microphone 430 and a second microphone 440, wherein first microphone 430 and the second microphone 440 form a portion of an antenna array 450.

The communications processor 410 is operative to process signals received via a wireless network, such as from a cellular telephone or data network, and to prepare signals for transmission via a wireless network. The communications processor 410 may be configured to receive audio signals from the signal processor 420, to format the audio signal into a format suitable for transmission via a communications network or the like and to couple this formatted audio signal to a network interface, a universal serial port, an antenna or other transmission means. The communications processor 410 may be further configured for generating a speaker signal representative of an audio signal, for coupling to a speaker or the like for broadcasting within a vehicle cabin.

The exemplary system 400 may further include a microphone array 450 including a first microphone 430 and a second microphone 440, for receiving acoustic signals. The microphone array 450 may be mounted within a vehicle cabin for receive a desired acoustic voice signal from a participant in a hand free calling session. For example, the participant may be a vehicle operator engaging in a hand free telephone call via a mobile device connected to a vehicle infotainment system where received voice acoustic signals are broadcast within the vehicle cabin by infotainment system speakers and the outgoing voice acoustic signals, such as the operator's voice, is detected by the microphone array 450 and coupled to the signal processor 420 for further processing before transmission via a wireless network. In some examples, the transmission and reception of the wireless network signals may be made by the mobile device. In other examples, the vehicle may include a wireless communications system for transmitting and receiving data via the wireless network.

The microphone array 450 is configured to receive an incoming acoustic signal including a desired acoustic signal and an undesired acoustic signal. In some examples, the desired acoustic signal may be a conversation participants voice and the undesired signal may be another occupant's voice, vehicle system noise, or other noise from a source within the vehicle cabin. The microphone array 450 may couple the incoming acoustic signal to a signal processor 420 or the like. In some examples, the microphone array 450 may include an analog to digital converter, a tuner and/or downconverter for altering the frequency of the incoming acoustic signal.

The signal processor 420 may be configured to perform a first beamforming operation on the incoming acoustic signal to isolate the desired signal from the incoming acoustic signal in a first signal path. The first signal path may be a desired signal path. The first beamforming operation on the incoming acoustic signal may include applying a linear weight to a phase angle of the undesired signal. The signal processor 420 may be further configured to perform a second beamforming operation to isolate the undesired signal from the incoming acoustic signal in a second signal path. The second signal path may be an undesired signal path. The second beamforming operation on the incoming acoustic signal may include applying a linear weight to a phase angle of the desired signal. While this exemplary embodiment describes a first beamforming operation to isolate a desired signal and a second beamforming operation to isolate an undesired signal, the signal processor 420 may be configured to perform a plurality of beamforming operations to isolate multiple desired signals and/or multiple undesired signals and generate an output signal including the multiple desired signals according to the described systems and methods.

The signal processor 420 may next filter the desired signal to generate a filtered desired signal. The filtering may be performed using an adaptive filtering algorithm or the like. The filtering of the desired signal may be an adaptive filtering operation with a frequency centered on the frequency of the desired signal. The filtered desired signal may include the desired signal with other signals attenuated by the filtering process. For example, the adaptive filtering algorithm may attenuate any remaining undesired signal from the incoming acoustic signal that may remain after the first beamforming operation.

The signal processor 420 is next operative to combines an inverse of the filtered desired signal with the undesired signal to generate a combined undesired signal. This may have the desirable effect of cancelling or further attenuating any desired signal remaining within the undesired signal path after the second beamforming operation. The processor 420 is next operative for filtering the combined undesired signal to generate a filtered combined undesired signal. This filtering process may be an adaptive filtering processor to further reduce any desired signal that may remain in the undesired signal path. The signal processor 420 may then combine an inverse of the combined undesired signal and the desired signal to generate an output signal, thereby cancelling all, or a portion, of any remaining undesired signal within the desired signal path. The signal processor 420 may then couple the output signal to the communications processor 410 to generate a data signal in response to the output signal for transmission via a wireless network.

In some exemplary embodiments, the system 400 may be a hands-free telecommunications system within a vehicle cabin including a microphone array 450 to receive an incoming acoustic signal including a desired signal and an undesired signal and an analog to digital converter to convert the incoming acoustic signal to a digital signal including the desired voice signal and the undesired voice signal. The system may further include a processor 420, such as a digital signal processor, to perform a first beamforming operation on the digital signal to isolate the desired signal from the digital signal, to perform a second beamforming operation to isolate the undesired signal from the digital signal, filtering the desired signal to generate a filtered desired signal, combining an inverse of the filtered desired signal with the undesired signal to generate a combined undesired signal, filtering the combined undesired signal to generate a filtered combined undesired signal and combining an inverse of the combined undesired signal and the desired signal to generate an output signal. In some embodiments, the first operation and/or the second beamforming operation may apply a linear weight to a phase angle of the undesired signal. Some exemplary systems 400 may further include a communications processor to generate a data signal in response to the output signal for transmission via a wireless network.

Figure 5:
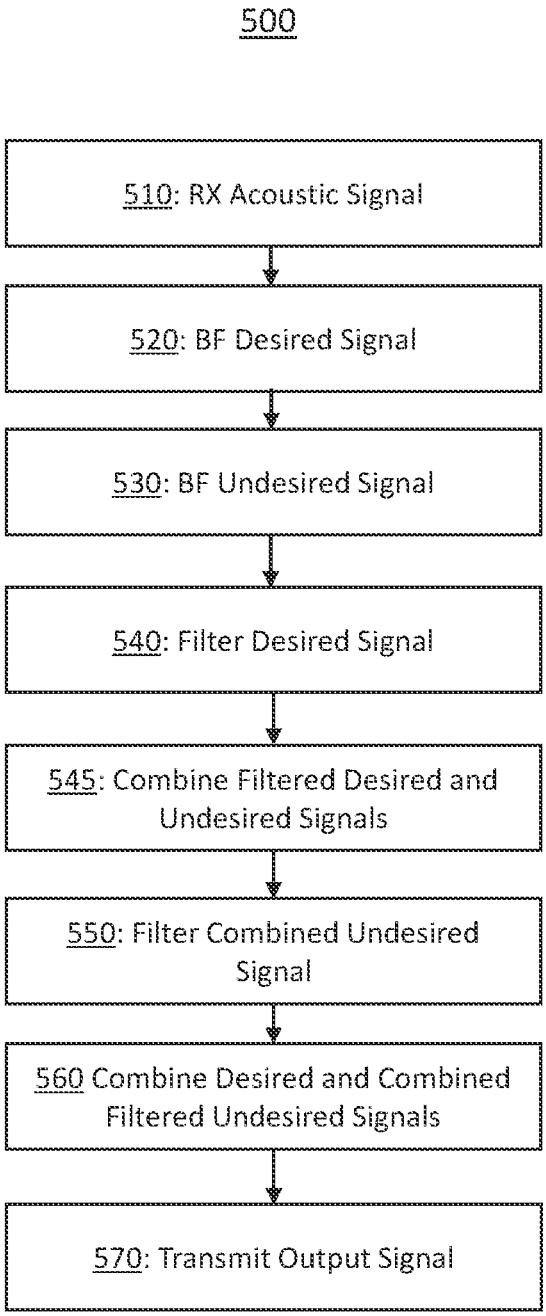
FIG. 5 shows a flow chart illustrating another exemplary method for providing beamforming techniques for acoustic interference cancellation in a bidirectional vehicle communications system according to another exemplary embodiment.

Turning now to FIG. 5, a flow chart illustrating an exemplary implementation of a system 500 for providing beamforming techniques for acoustic interference cancellation in a bidirectional vehicle communications system is shown. The exemplary method 500 is first operative for receiving 510, via a microphone array, an incoming acoustic signal including a desired signal and an undesired signal. The microphone array may include a plurality of microphones within a vehicle passenger cabin. the undesired signal originates from a first source at a first location within a vehicle cabin and the desired signal originates from a second source at a second location within the vehicle cabin. the desired signal an outgoing portion of a bidirectional voice communications and wherein the wireless network is a cellular network.

The method is next operative to perform 520 a first beamforming operation, by a signal processor, on the incoming to isolate the desired signal from the incoming acoustic signal; the first beamforming operation on the incoming acoustic signal is further configured to apply a linear weight to a phase angle of the undesired signal.

Next, a second beamforming operation, is performed 530 by the signal processor, to isolate the undesired signal from the incoming acoustic signal; the second beamforming operation on the incoming acoustic signal is further configured to apply a linear weight to a phase angle of the desired signal.

The desired signal that was partially isolated by the first beamforming operation is then filtered 540 by the signal processor to further attenuate any remaining undesired signal to generate a filtered desired signal. In some exemplary embodiments, the filtering of the desired signal may be an adaptive filtering with a frequency centered on the frequency of the desired signal.

The filtered desired signal is next inverted and combined 545 with the undesired signal to generate a combined undesired signal. Adding the inverse of the desired signal to the undesired signal within the undesired signal path has the advantageous of cancelling or reducing the amplitude of any desired signal remaining in the undesired signal path after the second beamforming operation. The combined undesired signal is next filtered 550, by the signal processor, to further suppress any remaining desired signal or other noise to generate a filtered combined undesired signal. The filtering of the combined undesired signal may estimate the undesired signal component as received by the desired signal path.

The method next combines 560, by the signal processor, an inverse of the combined undesired signal and the desired signal to generate an output signal. This combining of the signals advantageously attenuates the undesired signal present on the desired signal path after the first beamforming operation. Furthermore, since the desired signal has been greatly attenuated on the undesired signal path, the desired signal on the desired signal is not significantly impacted by a combination of the inverse of the desired signal on the undesired signal path.

Finally, a communications processor may be configured for generating 570 a data signal in response to the output signal for transmission via a wireless network. The output signal may be coupled to the communications processor by the signal processor or other device. The wireless network may be a cellular communications or wireless data communications network or may be a vehicle to vehicle, vehicle to infrastructure, or vehicle to all communications.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An apparatus comprising:

a microphone array configured to receive an incoming acoustic signal including a desired signal and an undesired signal;

a signal processor configured to perform a first beamforming operation on the incoming acoustic signal to isolate the desired signal from the incoming acoustic signal, to perform a second beamforming operation to isolate the undesired signal from the incoming acoustic signal, filtering the desired signal to generate a filtered desired signal, combining an inverse of the filtered desired signal with the undesired signal to generate a combined undesired signal, filtering the combined undesired signal to generate a filtered combined undesired signal and combining an inverse of the filtered combined undesired signal and the desired signal to generate an output signal; and a communications processor to generate a data signal in response to the output signal for transmission via a wireless network.

2. The apparatus of claim 1, wherein the microphone array includes a plurality of microphones within a vehicle passenger cabin.

3. The apparatus of claim 1, wherein the first beamforming operation on the incoming acoustic signal is further configured to apply a linear weight to a phase angle of the undesired signal.

4. The apparatus of claim 1, wherein the filtering of the desired signal includes an adaptive filtering with a frequency centered on the frequency of the desired signal.

5. The apparatus of claim 1, wherein the second beamforming operation on the incoming acoustic signal is further configured to apply a linear weight to a phase angle of the desired signal.

6. The apparatus of claim 1, wherein the desired signal includes an outgoing portion of a bidirectional voice communications and wherein the wireless network is a cellular network.

7. The apparatus of claim 1, wherein the filtering of the combined undesired signal attenuates the desired signal with the combined undesired signal.

8. The apparatus of claim 1, wherein the undesired signal originates from a first source at a first location within a vehicle cabin and the desired signal originates from a second source at a second location within the vehicle cabin.

9. A method comprising:

receiving, via a microphone array, an incoming acoustic signal including a desired signal and an undesired signal;

performing a first beamforming operation, by a signal processor, on the incoming acoustic signal to isolate the desired signal;

performing a second beamforming operation, by the signal processor, on the incoming acoustic signal to isolate the undesired signal;

filtering, by the signal processor, the desired signal to generate a filtered desired signal, combining an inverse of the filtered desired signal with the undesired signal to generate a combined undesired signal;

filtering, by the signal processor, the combined undesired signal to generate a filtered combined undesired signal;

combining, by the signal processor, an inverse of the filtered combined undesired signal and the desired signal to generate an output signal; and generating, by a communications processor, a data signal in response to the output signal for transmission via a wireless network.

10. The method of claim 9, wherein the microphone array includes a plurality of microphones within a vehicle passenger cabin.

11. The method of claim 9, wherein the second beamforming operation on the incoming acoustic signal is further configured to apply a linear weight to a phase angle of the desired signal.

12. The method of claim 9, wherein the filtering of the desired signal includes an adaptive filtering with a frequency centered on the frequency of the desired signal.

13. The method of claim 9, wherein the first beamforming operation on the incoming acoustic signal is further configured to apply a linear weight to a phase angle of the undesired signal.

14. The method of claim 9, further comprising performing a third beamforming operation, by the signal processor, on the incoming acoustic signal to isolate a second undesired signal, combining a second inverse of the filtered desired signal with the second undesired signal to generate a second combined undesired signal, filtering, by the signal processor, the second combined undesired signal to generate a second filtered combined undesired signal and combining, by the signal processor, an inverse of the second combined undesired signal and the desired signal to form a portion of the output signal.

15. The method of claim 9, wherein the filtering of the combined undesired signal attenuates the desired signal with the combined undesired signal.

16. The method of claim 9, wherein the undesired signal originates from a first source at a first location within a vehicle cabin and the desired signal originates from a second source at a second location within the vehicle cabin.

17. The method of claim 9, wherein the desired signal an outgoing portion of a bidirectional voice communications and wherein the wireless network is a cellular network.

18. A hands-free telecommunications system within a vehicle cabin comprising:

a microphone array to receive an incoming acoustic signal including a desired signal and an undesired signal;

an analog to digital converter to convert the incoming acoustic signal to a digital signal including the desired signal and the undesired signal;

a digital signal processor to perform a first beamforming operation on the digital signal to isolate the desired signal from the digital signal, to perform a second beamforming operation to isolate the undesired signal from the digital signal, to filter the desired signal to generate a filtered desired signal, to combine an inverse of the filtered desired signal with the undesired signal to generate a combined undesired signal, to filter the combined undesired signal to generate a filtered combined undesired signal and to combine an inverse of the filtered combined undesired signal and the desired signal to generate an output signal; and a communications processor to generate a data signal in response to the output signal for transmission via a wireless network.

19. The hands-free telecommunications system within a vehicle cabin of claim 18, wherein the first beamforming operation on the incoming acoustic signal is further configured to apply a linear weight to a phase angle of the undesired signal.

* * * * *